US010810946B2

(12) United States Patent
Han et al.

(10) Patent No.: US 10,810,946 B2
(45) Date of Patent: Oct. 20, 2020

(54) GATE CLOCK GENERATOR AND DISPLAY DEVICE HAVING THE SAME

(71) Applicant: LG Display Co., Ltd., Seoul (KR)

(72) Inventors: Jaewon Han, Paju-si (KR); Soondong Cho, Daegu (KR); Jungjae Kim, Paju-si (KR); Sanguk Lee, Daegu (KR); Hyungjin Choe, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/503,050

(22) Filed: Jul. 3, 2019

(65) Prior Publication Data

US 2020/0020280 A1 Jan. 16, 2020

(30) Foreign Application Priority Data

Jul. 12, 2018 (KR) ..... 10-2018-0081288

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/0278* (2013.01)

(58) Field of Classification Search
None
See application file for complete search history.

(56) References Cited

U.S. PATENT DOCUMENTS

2004/0155851 A1* 8/2004 Morii ..... G09G 3/3677 345/99
2005/0122295 A1* 6/2005 Sawabe ..... G09G 3/3614 345/88
2008/0136756 A1* 6/2008 Yeo ..... G09G 3/3677 345/87

* cited by examiner

*Primary Examiner* — Aneeta Yodichkas
(74) *Attorney, Agent, or Firm* — Seed IP Law Group LLP

(57) ABSTRACT

The present disclosure provides a gate clock generator including a counter, a buffer control signal generator, and an output unit. The counter receives control data having rising timing information and falling timing information and a main clock. The counter generates a first output when a value is obtained by counting the main clock from a preset reference time point reaches rising data. The counter further generates a second output when a value is obtained by counting the main clock from the reference time point reaches falling data. The buffer control signal generator generates a first buffer control signal of a gate ON voltage from a timing of the first output to a timing of the second output. The output unit outputs a gate ON voltage of a gate clock during an output period of the gate ON voltage of the first buffer control signal.

16 Claims, 23 Drawing Sheets

GATE CLOCK GENERATOR AND DISPLAY DEVICE HAVING THE SAME

CROSS-REFERENCE TO RELATED APPLICATIONS

This application claims the benefit of Korea Patent Application No. 10-2018-0081288 filed on Jul. 12, 2018, the entire contents of which is incorporated herein by reference for all purposes as if fully set forth herein.

BACKGROUND

Technical Field

The present disclosure relates to a gate clock generator and a display device including the same.

Description of the Related Art

In a display device, data lines and gate lines arranged to intersect each other and pixels are arranged in a matrix form. A driving circuit for driving a display device includes a timing controller generating a timing control signal, a data driver supplying a data voltage for video to be displayed on the data lines, and a gate driver sequentially supplying gate pulses to the gate lines. The gate driver includes a shift register for sequentially outputting gate pulses and a level shifter for determining an output voltage of the shift register.

The level shifter outputs a gate clock swinging between a gate high voltage and a gate low voltage according to clock signals provided from timing control signals. The gate clock output from the level shifter is determined by preset timing control signals and is not varied. In particular, since each of the gate clocks output from the level shifter is sequentially shifted, the gate pulses applied to the lines of the display panel have a limitation that they have the same phase and the same pulse width.

BRIEF SUMMARY

A gate clock generator of the present disclosure includes a counter, a buffer control signal generator, and an output unit. The counter receives control data having rising timing information and falling timing information and a main clock, generates a first output when a value obtained by counting the main clock from a preset reference time point reaches rising data, and generates a second output when a value obtained by counting the main clock from the reference time point reaches falling data. The buffer control signal generator generates a first buffer control signal of a gate ON voltage from a timing of the first output to a timing of the second output. The output unit outputs a gate ON voltage of a gate clock during an output period of the gate ON voltage of the first buffer control signal.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
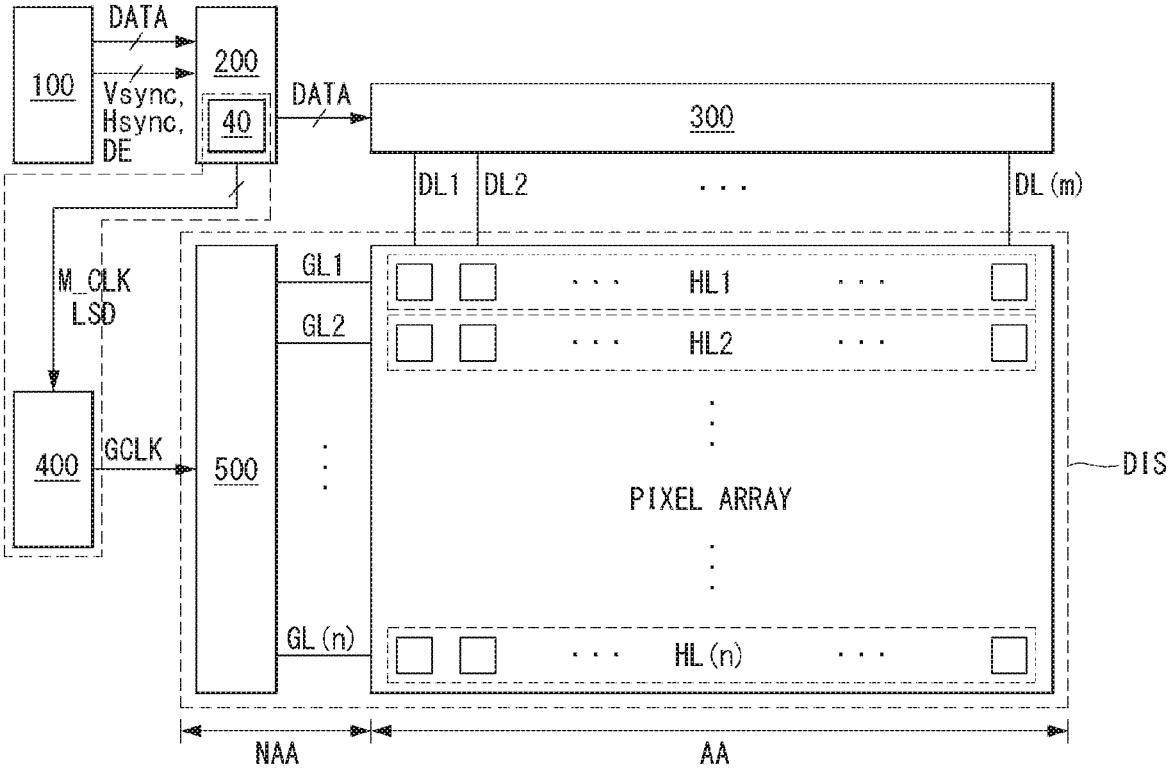
FIG. 1 is a view illustrating an organic light emitting display device according to the present disclosure.

Hereinafter, embodiments of the present disclosure will be described in detail with reference to the accompanying drawings. Like reference numerals refer to like elements throughout the disclosure. Further, in the description of the present disclosure, detailed description of known related arts will be omitted if it is determined that the gist of the present disclosure is unnecessarily obscured.

In the present disclosure, switching elements may be realized as transistors having an n type or p type metal oxide semiconductor field effect transistor (MOSFET) structure. The transistor is a three-electrode element including a gate, a source, and a drain. The source is an electrode that supplies a carrier to the transistor. In the transistor, carriers start to flow from the source. The drain is an electrode through which the carriers exit from the transistor. That is, in the MOSFET, the carriers flow from the source to the drain. In the case of the n-type MOSFET (NMOS), the carriers are electrons, and thus, a source voltage is lower than a drain voltage so that electrons may flow from the source to the drain. In the n-type MOSFET, electrons flow from the source to the drain, and thus, current flows from the drain to the source. In contrast, in the case of a p-type MOSFET (PMOS), since carriers are holes, a source voltage is higher than a drain voltage so that holes may flow from the source to the drain. In the p-type TFT, since holes flow from the source to the drain, current flows from the source to the drain. It should be noted that the source and the drain of the MOSFET are not fixed. For example, the source and the drain of the MOSFET may be changed depending on an applied voltage. Therefore, in the following embodiments, the present disclosure is not limited due to the source and the drain of the transistor.

FIG. 1 is a schematic block diagram illustrating an organic light emitting display device.

Referring to FIG. 1, the organic light emitting display device according to an embodiment of the present disclosure includes a display panel DIS in which pixels P are formed, a timing controller 200 for generating a timing control signal, gate drivers 400, 500 for driving gate lines GL1 to GLn, and a data driver 300 for driving data lines DL1 to DLm.

The display panel DIS includes a display area AA in which pixels P are arranged to display an image and a non-display area NAA in which no image is displayed. The non-display area NAA surrounds an outer portion of the display area AA and may be referred to as a bezel.

The plurality of data lines DL1 to DLm and the plurality of gate lines GL1 to GLn intersect each other in the display area AA of the display panel DIS and pixels P are arranged in a matrix form at the intersection, respectively. Each of the pixel lines HL1 to HLn includes pixels arranged in the same row. When the number of pixels P arranged in the display area AA is m×n, the display area AA includes n pixel lines. In this disclosure, each of the pixels P refers to any one of a red subpixel, a green subpixel, or a blue subpixel for color representation. Transistors constituting the pixels P may be implemented as oxide transistors each including an oxide semiconductor layer. The oxide transistor is advantageous for large-sized display panel DIS in consideration of both electron mobility, process variation, and the like. However, the present disclosure is not limited thereto and the semiconductor layer of the transistor may be formed of amorphous silicon, polysilicon, or the like.

Pixels P arranged in the first pixel line HL1 are connected to a first gate line GL1 and pixels P arranged in the nth pixel line HLn are connected to an nth gate line GLn. Each of the gate lines GL1 to GLn may include a plurality of lines that provide one or more gate signals.

The timing controller 200 rearranges input image data DATA provided from a host 100 according to resolution of the display panel DIS and supplies the rearranged image data to the data driver 300. The timing controller 200 also generates a data control signal for controlling an operation timing of the data driver 300 on the basis of timing signals such as a vertical synchronization signal Vsync, a horizontal synchronization signal Hsync, a data enable signal DE, and the like. Also, the timing controller 200 includes a reference data generator 400 for controlling an operation timing of the gate drivers 400, 500. The reference data generator 400 generates a main clock M_CLK and control data LSD on the basis of the timing signals. The main clock M_CLK is a digital logic signal applied at regular intervals. The control data LSD may include any one of pulse width information of a gate clock, slew rate information, and gate pulse modulation (GPM) information.

The data driver 300 converts the input image data DATA provided from the timing controller 200 into an analog data voltage on the basis of the data control signal.

The gate drivers 400, 500 include a gate clock generator 400 and a shift register 500. The gate clock generator 400 receives the main clock M_CLK and the control data LSD from the timing controller 200 and generates gate clocks GCLK on the basis of the control data LSD. The gate clock generator 400 counts the main clock M_CLK on the basis of information included in the control data LSD to adjust a rising timing, a falling timing, and GPM timing of the gate clocks GCLK. That is, the gate clock generator 400 according to the present disclosure generates gate clocks having a pulse width and a duty ratio different from those of an input clock according to the information of the digital control data LSD, rather than simply shifting a voltage level of the clock signal provided from the timing controller 200. Therefore, the gate clock generator 40 of the present disclosure may easily vary the pulse width, the output timing, and the GPM timing of the gate clocks GCLK by varying only the control data LSD, which is digital data. Also, the gate clock generator GCLK may adjust a slew rate and a GPM voltage level of the gate clocks GCLK on the basis of information included in the control data LSD. A specific embodiment of the gate clock generator 400 will be described later.

The shift register 500 outputs gate pulses on the basis of the gate clocks output from the gate clock generator 400. To this end, the shift register 500 includes stages which are dependently connected to each other. The shift register 500 may be formed directly on the non-display area NAA of the display panel DIS using a gate-driver in panel (GIP) process.

Each of the first to nth gate lines GL1 to GLn of the display panel DIS may include one or more signal lines. For example, in the organic light emitting display device, each of the first to nth gate lines GL1 to GLn may include a scan line for applying a scan signal and a sense line for applying a sense signal. That is, the first gate line GL1 may include a first scan line for applying a first scan signal and a first sense line for applying a first sense signal. In order to drive such a display panel, a first gate clock output from the gate clock generator 400 may include a first scan clock for determining an output timing of the first scan signal and a first sense clock for determining an output timing of the first sense signal.

Hereinafter, a configuration and operation of the gate clock generator according to the present disclosure will be described in detail. In the present disclosure, first to third embodiments will be described focusing on the operation of outputting a scan clock among the gate clocks.

Figure 2:
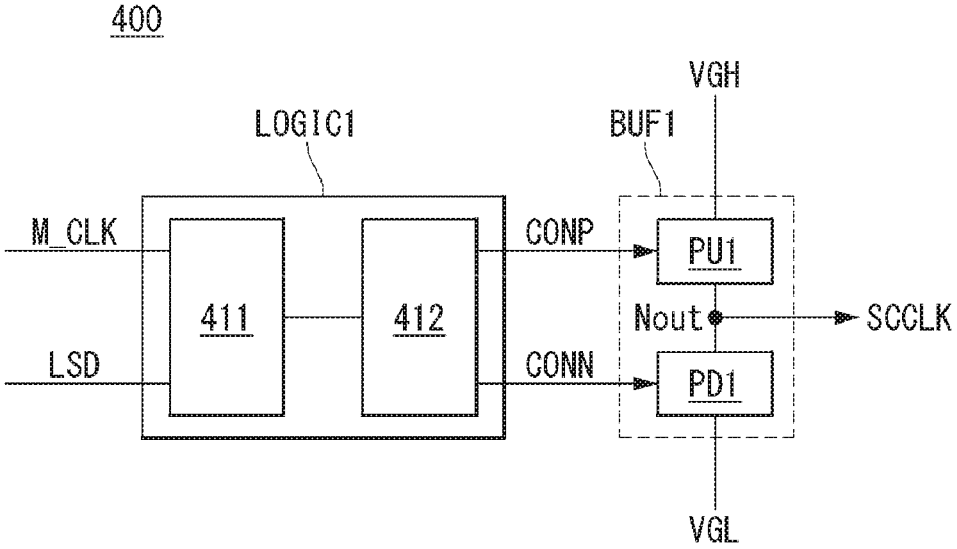
FIG. 2 is a view illustrating a gate clock generator according to a first embodiment.
Figure 3:
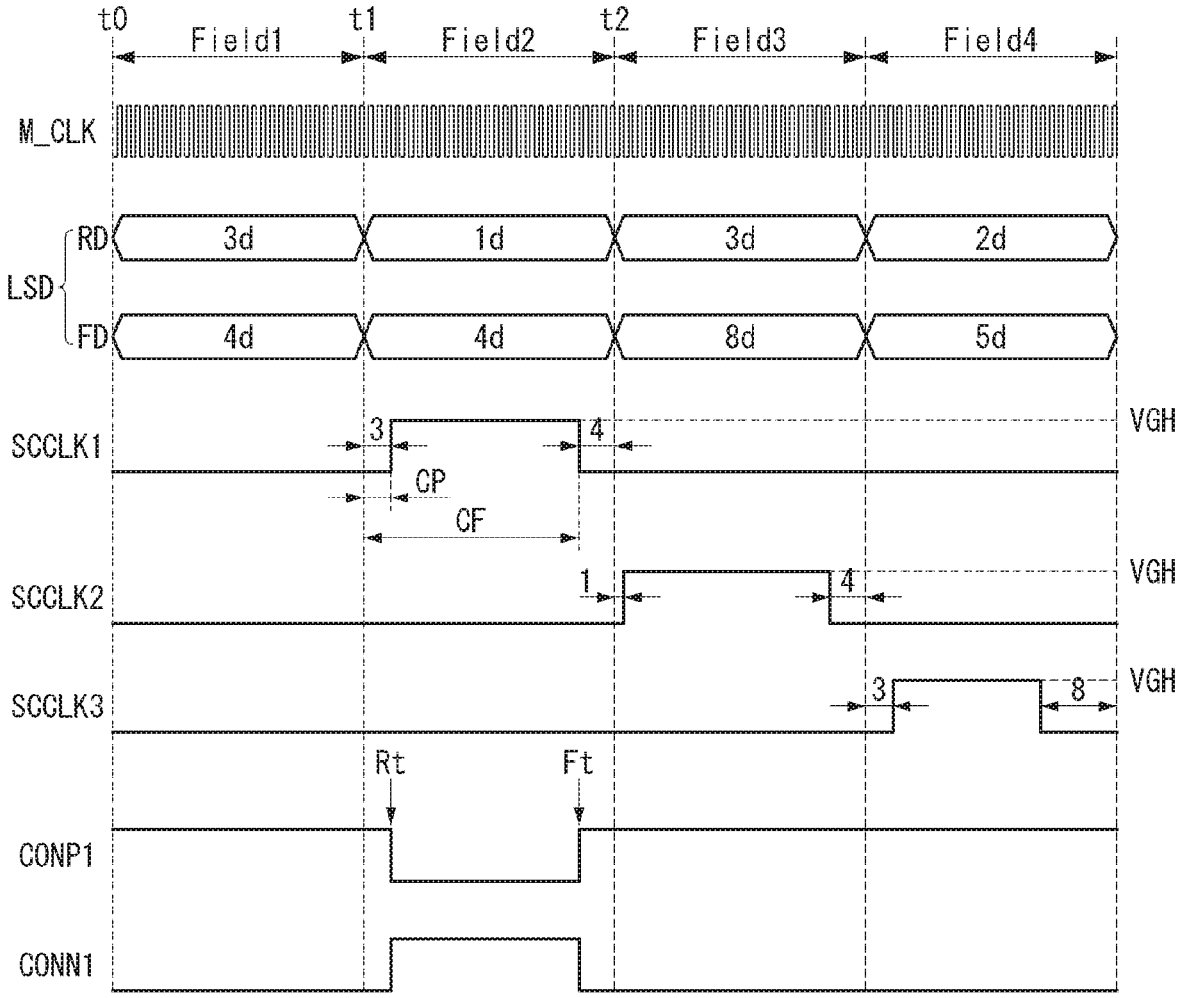
FIG. 3 is a view illustrating a driving signal and an output signal of a gate clock generator according to the first embodiment.

FIG. 2 is a view illustrating a gate clock generator according to the first embodiment. FIG. 3 is a view illustrating input signals and output signals of the gate clock generator according to the first embodiment, and FIG. 4 is a view illustrating a buffer unit according to the first embodiment.

Figure 4:
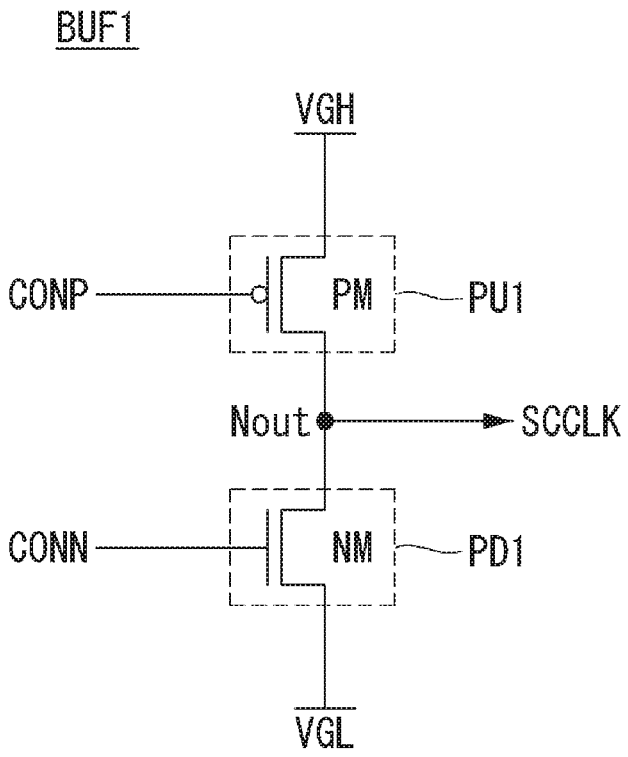
FIG. 4 is a view illustrating a buffer unit according to the first embodiment.

Referring to FIGS. 2 to 4, the gate clock generator 400 according to the first embodiment includes a logic unit LOGIC1 and a buffer unit BUF 1.

The logic unit LOGIC1 receives the main clock M_CLK and the control data LSD and generates a buffer control signal on the basis of the main clock M_CLK and the control data LSD. To this end, the logic unit LOGIC1 includes a counter 411 and a buffer control signal generator 412. In one or more embodiments, the term "unit" used herein may be broadly construed to be a circuit, a module of an electronic system, a subsystem or a system implemented using electronic circuitry, one or more functioning unit structure of a larger system, or the like.

The counter 411 receives the main clock M_CLK and the control data LSD and counts the main clock M_CLK according to information of the control data LSD belonging to one field to adjust a timing of first and second buffer control signals CONP and CONN.

Each of the fields Field1 to Field4 may be set to a period for driving one pixel line HL, and for example, one field may be set to a 1H period. In one embodiment, the 1H period may be defined as a period for writing a data voltage into one pixel line. The main clock M_CLK includes a pulse string whose voltage level is inverted at regular intervals. Accordingly, the pulses of the main clock M_CLK belonging to each field have the same number.

The control data LSD includes rising data RD and falling data FD. The rising data RD includes rising timing information of a scan clock SCCLK and the falling data FD includes falling timing information of the scan clock SCCLK. In FIG. 3, "x" in "xd" marked in the rising data RD and the falling data FD is information for defining a first count value CP and a second count value CF to be described later.

The counter 411 counts pulses of the main clock M_CLK, starting from a preset reference time point, and generates a first output Rt when a counted value reaches the first count value CP.

The reference time point is set to a time point after the lapse of a predetermined time after the rising data RD is input, in consideration of a calculation time of the logic unit LOGIC. FIG. 3 illustrates an embodiment in which a time point after a 1 field period has lapsed since the rising data RD was input is set to the reference time point. For example, a reference time point of the rising data RD applied at a time point "t0" is set to "t1", and a reference time point of the rising data RD applied at the time point "t1" is set to "t2".

When the rising data RD is "xd", the first count value CP corresponds to "x".

That is, when the rising data RD applied at the time point "t0" is "3", if a value obtained by counting the main clock M_CLK from "t1" corresponds to "3", the counter 411 outputs the first output Rt.

The counter 411 counts pulses of the main clock M_CLK from the reference time point and generates a second output Ft when a counted value reaches the second count value CF. The second count value CF may be set to Equation 1.

$$CF = M\text{total} - x \quad \text{[Equation 1]}$$

Here, "Mtotal" is a total number of main clocks included in one field, and "x" is the size of the falling data.

Equation 1 is used to reduce the size of falling data. If the number of bits allocated to falling data is sufficiently large, the size of the falling data may be set to the second count value CF.

The buffer control signal generator 412 generates the first buffer control signal CONP having a turn-on voltage level from the rising time to the falling time. Also, the buffer control signal generator 412 generates the second buffer control signal CONN having a voltage level opposite to that of the first buffer control signal CONP. The first buffer control signal CONP is applied to a pull-up unit PU1 of the buffer unit BUF1 and the second buffer control signal CONN is applied to a pull-down unit PD1. FIG. 3 illustrates only a first first buffer control signal CONP1 and a first second buffer control signal CONN1 for controlling an output timing of the first scan clock SCCLK1 and a first buffer control signal CONP and a second buffer control signal CONN for controlling an output timing of other scan clocks may be generated in the same manner. Hereinafter, in this disclosure, the first and second buffer control signals CONP and CONN will be generally referred to, without limiting an output period.

The buffer unit BUF includes a pull-up unit PU applying a gate high voltage VGH to an output terminal Nout in response to the first buffer control signal CONP and a pull-down unit PD applying a gate low voltage VGL to the output terminal Nout in response to the second buffer control signal CONN. As in the embodiment, when the first buffer control signal CONN has a turn-on voltage at a low voltage level, a pull-up unit PU1 may be implemented as a PMOS PM and a pull-down unit PD1 may be implemented as an NMOS NM.

The control data LSD according to the present disclosure includes first to n-th rising data and first to n-th falling data to generate n scan clocks SCCLK. That is, in the present disclosure, an output timing of each of the gate pulses for driving the n gate lines may be easily adjusted.

Figure 5:
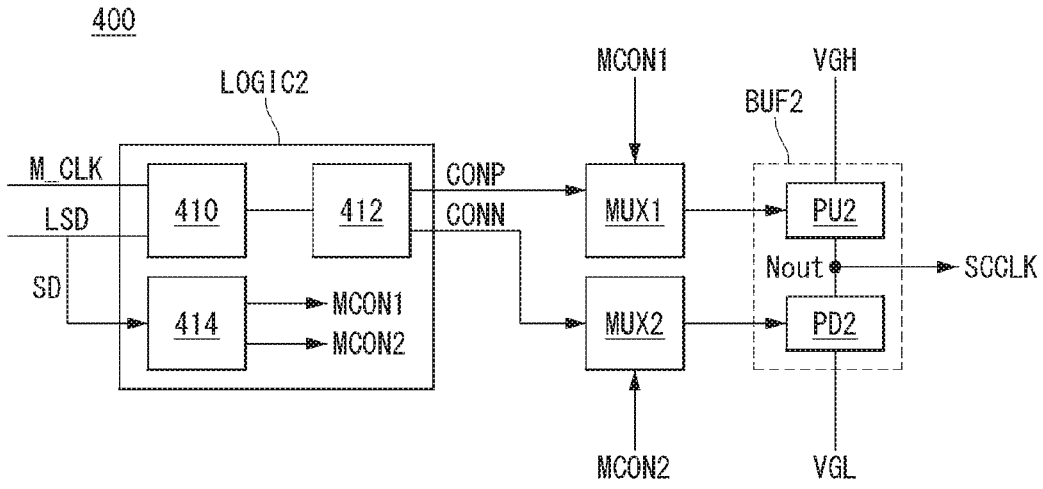
FIG. 5 is a view illustrating a gate clock generator according to a second embodiment.
Figure 6:
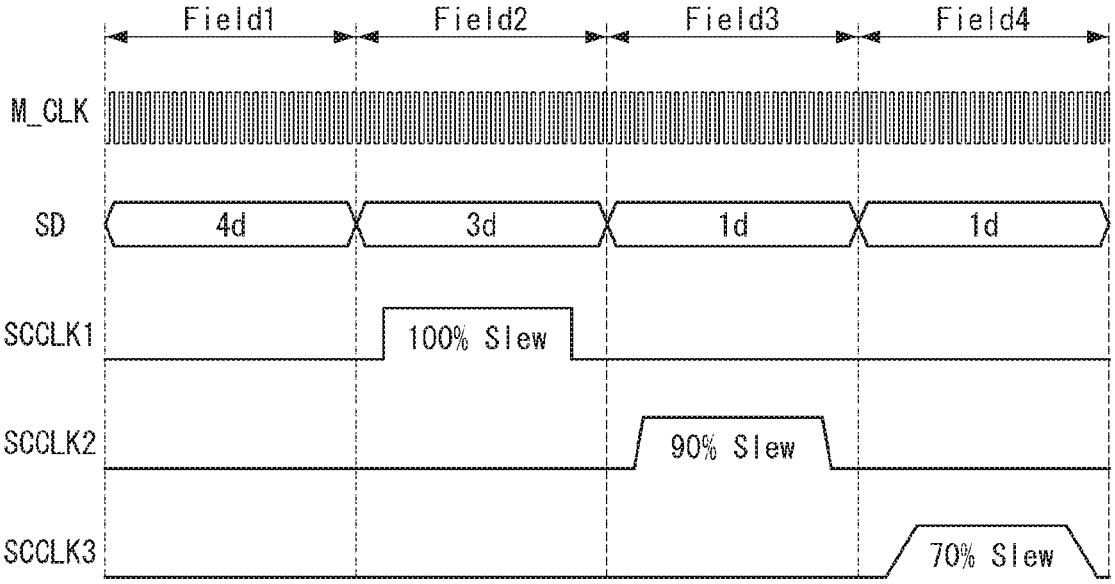
FIG. 6 is a view illustrating a driving signal and an output signal of a gate clock generator according to the second embodiment.
Figure 7:
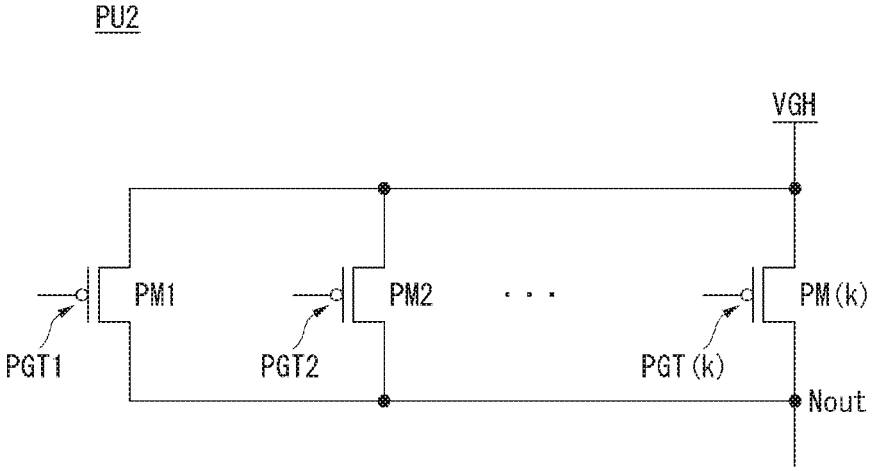
FIG. 7 is a view illustrating a pull-up unit of a buffer unit according to the second embodiment.
Figure 8:
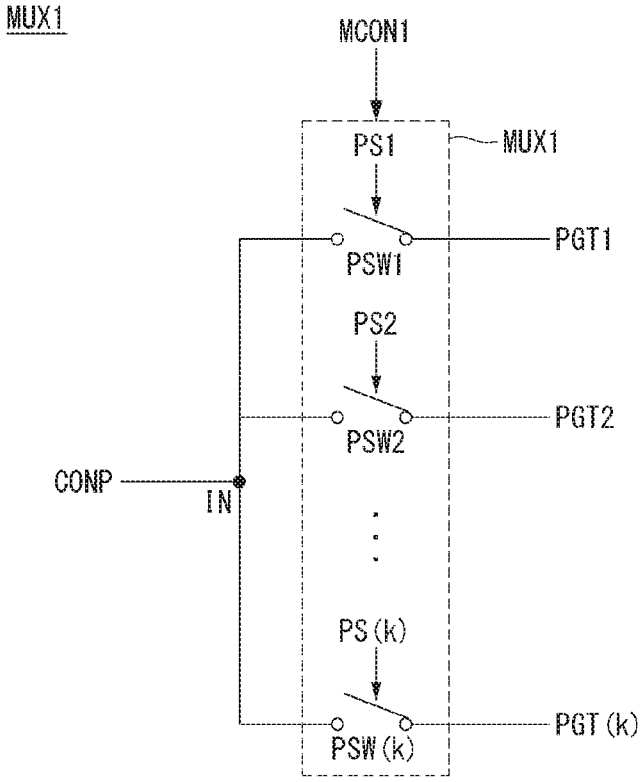
FIG. 8 is a view illustrating a first multiplexer.
Figure 9:
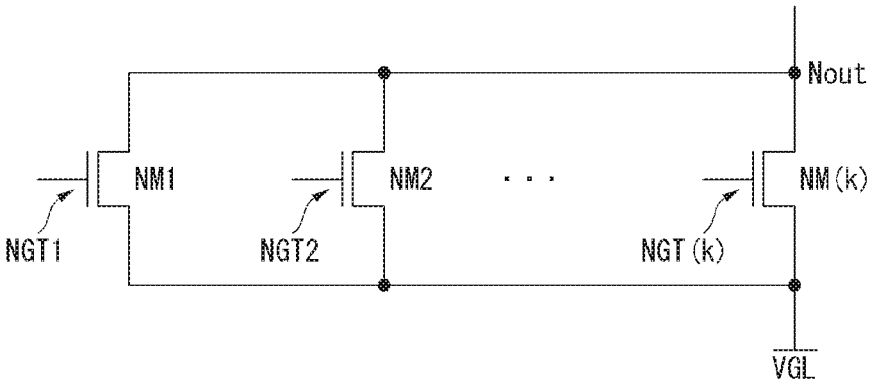
FIG. 9 is a view illustrating a pull-down unit of a buffer unit according to the second embodiment.
Figure 10:
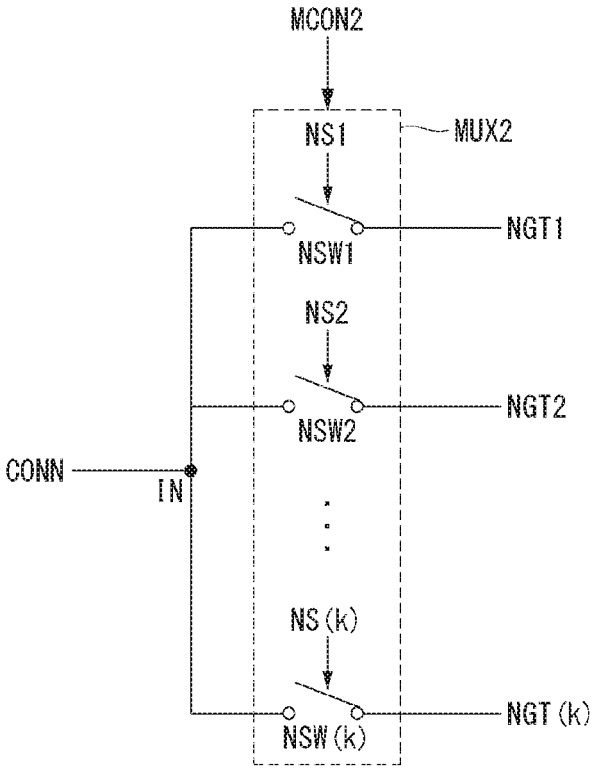
FIG. 10 is a view illustrating a second multiplexer.

FIG. 5 is a view illustrating a gate clock generator according to a second embodiment. FIG. 6 is a view illustrating input signals and gate clocks of a logic unit according to the second embodiment. FIG. 7 is a view illustrating a pull-up unit illustrated in FIG. 5 and FIG. 8 is a view illustrating a first multiplexer illustrated in FIG. 5. FIG. 9 is a view illustrating a pull-down unit illustrated in FIG. 5 and FIG. 10 is a view illustrating a second multiplexer illustrated in FIG. 5. In one or more embodiments, the multiplexer or the multiplexer controller used herein can include a multiplexer as well as a demultiplexer. The term "multiplexer" is used in the broadest sense to include any circuitry that is capable of performing a function of a multiple-input, single-output switch, or a single-input, multiple-output switch or in some cases, a multiple-input, multiple-output switch in which the number of inputs are different from the number of outputs, as might occur based on the various circuit designs.

A gate clock generator according to the second embodiment will now be described with reference to FIGS. 5 to 10. A detailed description of components of the second embodiment which are substantially the same as those of the previous embodiment will be omitted.

As illustrated in FIG. 5, the gate clock generator 400 according to the second embodiment includes a logic unit LOGIC2, first and second multiplexers MUX1 and MUX2, and a buffer unit BUF2.

The logic unit LOGIC2 includes a counter 411, a buffer control signal generator 412, and a multiplexer controller 414. The counter 411 and the buffer control signal generator 412 included in the logic unit LOGIC2 may have the same configuration and perform the same operation as those of the first embodiment described above. That is, although not shown in FIG. 6, the logic unit LOGIC2 according to the second embodiment may output the first buffer control signal CONP and the second buffer control signal CONN on the basis of the rising data RD and the falling data FD illustrated in FIG. 3. The multiplexer controller 414 adjusts the number of switches to be turned on included in the first and second multiplexers MUX1 and MUX2 on the basis of slew rate control data SD of the control data LSD. The operation of the multiplexer controller 414 will be described later.

The buffer unit BUF2 includes a pull-up unit PU2 for applying the gate high voltage VGH to an output terminal $N_{OUT}$ while the first buffer control signal CONP is at the gate ON voltage level and a pull-down unit PD2 applying the gate low voltage VGL to the output terminal Nout during an output period of the second buffer control signal CONN. The pull-up unit PU2 and the pull-down unit PD2 are implemented as a plurality of transistors connected in parallel, a slew rate is controlled according to the number of transistors to be turned on. A specific example thereof is as follows.

As illustrated in FIG. 7, the pull-up unit PU2 according to the second embodiment includes first to k-th PMOSs PM1 to PM(k) connected in parallel with each other. Source electrodes of the first to k-th PMOS PM1 to PM(k) are connected to the input terminal of the gate high voltage VGH, and the drain electrodes thereof are connected to the output terminal Nout of the gate clock. As illustrated in FIG. 8, the respective gate electrodes PGT1 to PGT(k) of the first to k-th PMOSs PM1 to PM(k) are connected to first to k-th pull-up control switches PSW1 to PSW(k), respectively. The first to k-th pull-up control switches PSW1 to PSW(k) are controlled on by first to k-th pull-up control signals PS1 to PS(k), respectively.

As illustrated in FIG. 9, the pull-down unit PD2 according to the second embodiment includes first to k-th NMOSs NM1 to NM(k) connected in parallel with each other. The source electrodes of the first to k-th NMOSs NM1 to NM(k) are connected to the input terminal of the gate low voltage VGL and drain electrodes thereof are connected to the output terminal Nout of the gate clock. As illustrated in FIG. 10, respective gate electrodes NGT1 to NGT(k) of the first to k-th NMOSs NM1 to NM(k) are connected to first to the k-th pull-down control switches NSW1 to NSW(k), respectively. The first to k-th pull-down control switches NSW1 to NSW(k) are controlled by first to k-th pull-down control signals NS1 to NS(k), respectively.

An operation of the multiplexer controller 414 to control a slew rate of the pull-up unit PU2 by controlling the switches of the first multiplexer MUX1 will now be described.

The multiplexer controller 414 outputs a first multiplexer control signal MCON1 on the basis of the slew rate data SD. The first multiplexer control signal MCON1 selects a switch to be turned on among the first to k-th pull-up control switches PSW1 to PSW(k) of the first multiplexer MUX1. To this end, the first multiplexer control signal MCON1 may include at least one of the first to the k-th pull-up control signals PS1 to PS(k).

In "xd" marked in the slew rate data SD illustrated in FIG. 6, "x" may be the number of the first to k-th pull-up control signals PS1 to PS(k) included in the first multiplexer control signal MCON1. For example, when the slew rate data SD is "1", the first multiplexer control signal MCON1 includes only the first pull-up control signal PS1. When the slew rate data SD is "2", the first multiplexer control signal MCON1 includes the first and second pull-up control signals PS1 and PS2. The slew rate data SD belonging to the first field Field1 may be set to control a slew rate of the scan clock SCCLK output during the period of the second field Field2, in consideration of a calculation time of the logic unit LOGIC2.

As the size of the slew rate data SD increases, the number of switches tp be turned on, among the first to k-th pull-up control switches PSW1 to PSW(k) of the first multiplexer MUX1 increases, and as a result, the number of PMOSs to be turned on, among the first to kth PMOSs PM1 to PM(k) of the pull-up unit PU2, increases. As the number of PMOSs to be turned on, among the first to kth PMOSs PM1 to PM(k) of the pull-up unit PU2, increases, turn-on resistance of the pull-up unit PU2 decreases. As the turn-on resistance of the pull-up unit PU2 decreases, a slew rate of the pull-up unit PU2 increases and a rising slope of the scan clock SCCLK increases.

As a result, the gate clock generator 400 according to the second embodiment may increase the slew rate the moment the scan clock SCCLK output from the pull-up unit PU2 rises in proportion to the slew rate data SD. For example, the gate clock generator 400 may adjust the slew rate of the first scan clock SCCLK1 output to the second field (Field2) on the basis of the slew rate data SD of "4" applied to the first field (Field1) to "100%". Similarly, the gate clock generator 400 may adjust the slew rate of the second scan clock SCCLK2 output to the third field (Field3) to "90%" on the basis of the slew rate data SD of "3" applied to the second field (Field2) and adjust the slew rate of the third scan clock SCCLK3 output to the fourth field (Field4) to "70%" on the basis of the slew rate data SD of "1" applied to the third field (Field3).

The operation of the multiplexer controller 414 to control the slew rate of the pull-down unit PD2 by controlling the switches of the second multiplexer MUX2 is performed in the same manner as the operation of controlling the slew rate of the pull-up unit PU2.

That is, the multiplexer controller 414 outputs the second multiplexer control signal MCON2 on the basis of the slew rate data SD. The second multiplexer control signal MCON2 selects a switch to be turned on among the first to k-th pull-down control switches NSW1 to NSW(k) of the second multiplexer MUX2. The multiplexer controller 414 increases the number of switches to be turned on among the first to the k pull-down control switches NSW1 to NSW(k) of the second multiplexer MUX2 as the size of the slew rate data SD increases. As a result, the number of NMOS transistors which are turned on among the first to k-th NMOS NM1 to NM(k) of the pull-down portion PD2 increases and the turn-on resistance of the pull down unit PD2 decreases. As a result, the gate clock generator 400 according to the second embodiment may increase the slew rate the moment the scan clock SCCLK output from the pull-down unit PD2 falls in proportion to the slew rate data SD.

Although the method of controlling the first and second multiplexers MUX1 and MUX2 on the basis of one slew rate data SD has been described in this disclosure, the slew rate data SD may be separated to individually control the first and second multiplexers MUX1 and MUX2.

Also, the size of the slew rate data and the slew rate is not limited to the embodiment illustrated in FIG. 6. For example, the slew rate may be set to be inversely proportional to the size of slew rate data.

Figure 11:
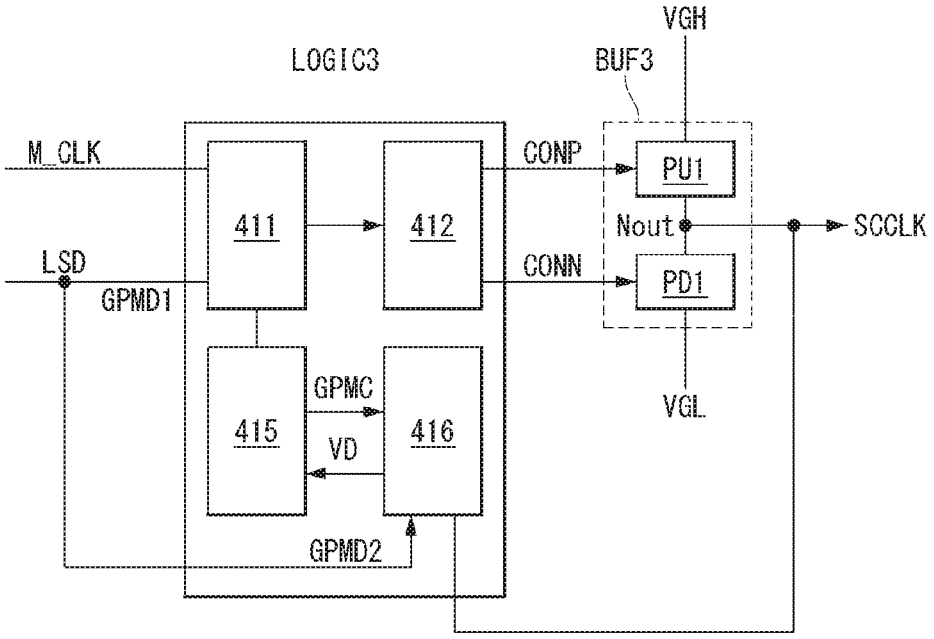
FIG. 11 is a view illustrating a gate clock generator according to a third embodiment.
Figure 12:
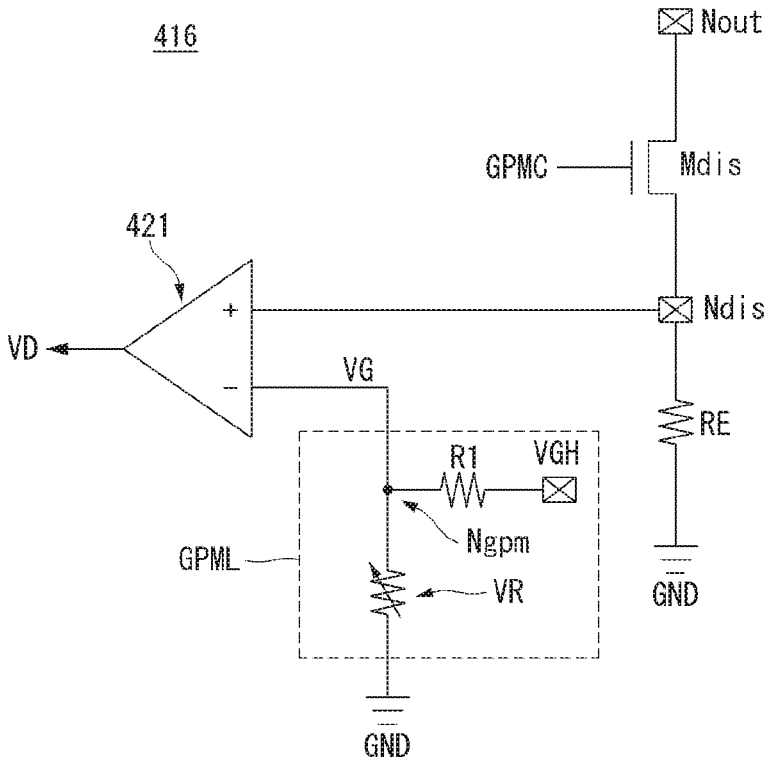
FIG. 12 is a view illustrating a gate pulse modulation (GPM) controller according to the third embodiment.
Figure 13:
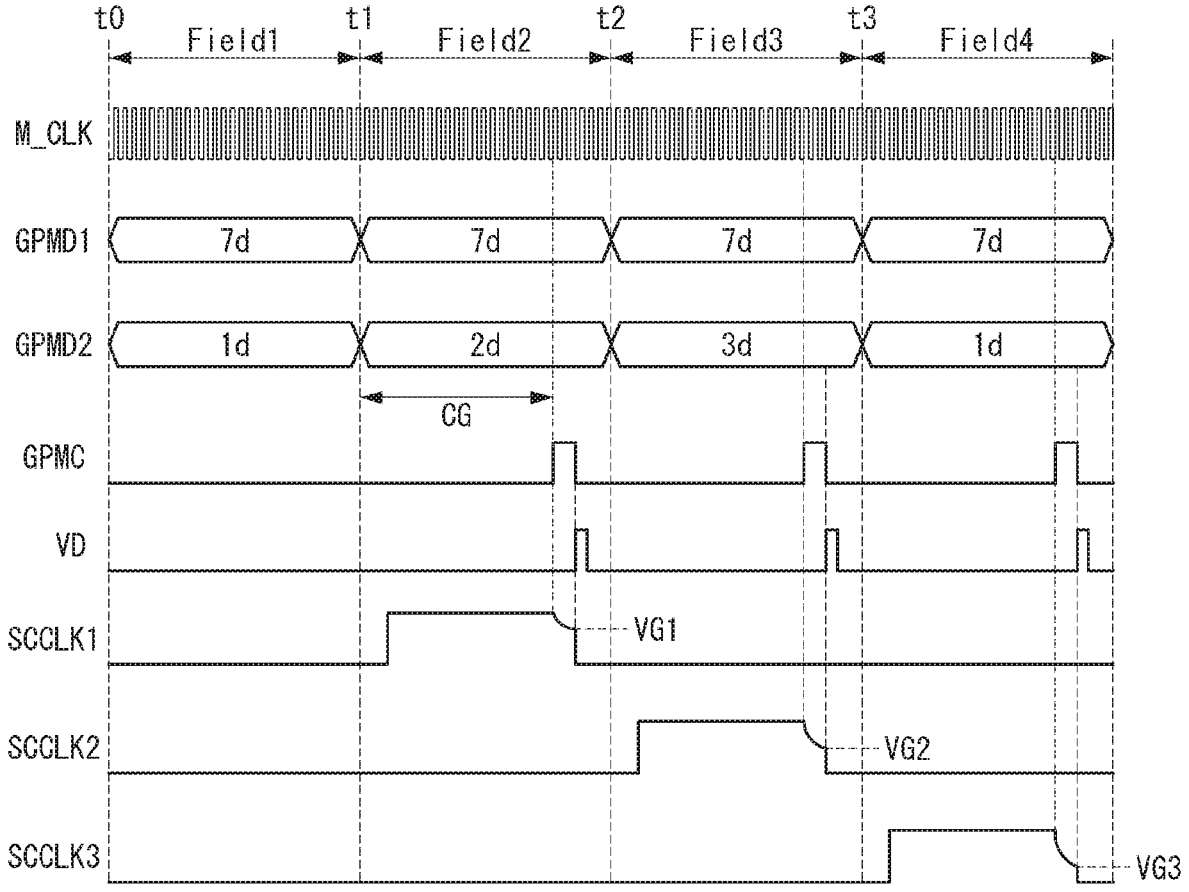
FIG. 13 is a view illustrating a driving signal and an output signal of a gate clock generator according to the third embodiment.

FIG. 11 is a view illustrating a gate clock generator according to a third embodiment of the present disclosure. FIG. 12 is a circuit diagram of a GPM controller of the gate clock generator. FIG. 13 is a view illustrating input signals and scan clocks of the gate clock generator according to the third embodiment.

The gate clock generator according to the third embodiment will be described with reference to FIGS. 11 to 13.

The gate clock generator LS3 according to the third embodiment includes a logic unit LOGIC 3 and a buffer unit BUF 3.

The logic unit LOGIC 3 includes a counter 411, a buffer control signal generator 412, a GPM control signal generator 415, and a GPM controller 416.

The counter 411 and the buffer control signal generator 412 of the logic unit LOGIC 3 may have the same configuration and perform the same operation as those of the first embodiment described above. That is, although rising data and falling data are not shown in FIG. 11, the logic unit LOGIC3 according to the third embodiment may output the first buffer control signal CONP and the second buffer control signal CONN on the basis of the rising data RD and the falling data FD illustrated in FIG. 3.

The GPM control signal generator 415 receives first GPM control data GPMD1 and adjusts a modulation timing of the scan clock SCCLK on the basis of the first GPM control data GPMD 1. The GPM controller 416 receives second GPM control data GPMD2 and adjusts a GPM level of the scan clock SCCLK on the basis of the second GPM control data GPMD2.

The buffer unit BUF3 applies the gate high voltage VGH to the output terminal Nout and the gate low voltage VGL to the output terminal Nout while the first buffer control signal CONP is at a gate ON voltage level. A specific embodiment of the buffer unit BUF3 may be implemented in the form of the first embodiment or the second embodiment described above.

The GPM control signal generator 415 and the GPM controller 416 will now be described in detail.

The GPM controller 416 includes a discharge control transistor Mdis and a comparator 421 as illustrated in FIG. 12. The discharge control transistor Mdis forms a current path between the output terminal Nout of the buffer unit BUF3 and a ground voltage GND in response to a GPM control signal GPMC. The comparator 421 compares a voltage level of a voltage of a discharge node Ndis with a voltage level of a GPM voltage VG output from the GPML level adjusting unit GPML, and when the voltage level of the GPM voltage VG is equal to or higher than the voltage of the discharge node Ndis, the comparator 421 outputs a falling signal VD.

The voltage level of the GPM voltage VG is varied by the GPM level adjusting unit GPML. The GPM level adjusting unit GPML adjusts the voltage level of the GPM voltage VG according to GPM level information defined by the second GPM control data GPMD2. FIG. 13 illustrates GPM voltage levels that G1" corresponds to the second GPM control data GPMD2 of "1*d*", "VG2" corresponds to the second GPM control data GPMD2 of "2*d*", and "VG3" corresponds to the second GPM control data GPMD2 of "3*d*".

The GPM level adjusting unit GPML may adjust the voltage level of the GPM voltage VG by adjusting a resistance value of a variable resistor VR.

Figure 14:
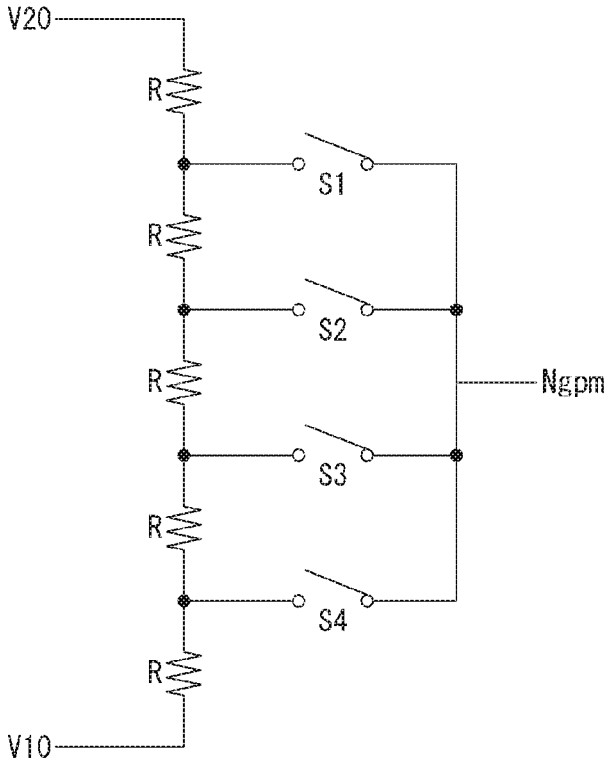
FIG. 14 is a view illustrating an embodiment of a GPM level adjusting unit.

FIG. 14 is a view illustrating an embodiment of the GPM level adjusting unit GPML.

Referring to FIG. 14, the GPM level adjusting unit GPML includes a plurality of resistors R connected in series between an input terminal of a first voltage V1 and an input terminal of a second voltage V2 and switches S1 to S4 connecting nodes between the resistors R and a GPM output node Ngpm outputting a GPM voltage VG. High data or low data assigned to each bit of the second GPM control data GPMD2 may be a turn-on or turn-off signal of the switches S1 to S4. In this manner, the GPM level adjusting unit GPML distributes a voltage between the first voltage V1 and the second voltage V2 according to a size of the second GPM control data GPMD2 and applies the voltage to the GPM output node Ngpm.

An embodiment in which the GPM control signal generator 415 generates the GPM control signal and adjusts a modulation timing of the gate clock on the basis of the generated GPM control signal will be described below.

The counter 411 counts pulses of the main clock M_CLK from the reference time point and generates an ON-level GPM control signal GPMC when the counted value reaches a GPM count value CG.

The reference time point is set to a time point after the lapse of a predetermined time after the first and second GPM control data GPMD1 and GPMD2 are input, in consideration of a calculation time of the logic unit LOGIC3. The reference time point may be set to be the same as the reference time point of the rising data RD and the falling data FD illustrated in FIG. 3. For example, the reference time point may be set to a time point after the lapse of one field period after the counter 411 receives the first and second GPM control data GPMD1 and GPMD2. Therefore, the reference time points of the first and second GPM control data GPMD1 and GPMD2 applied at a time point "t0" are set to "t1" and the reference time points of the first and second GPM control data GPMD1 and GPMD2 applied as a time point "t1" are set to "t2".

The GPM count value CG may be set to Equation 2 below.

$$CG = M\text{total} - y \quad \text{[Equation 2]}$$

Here, "Mtotal" is the total number of main clocks included in one field and "y" is the size of the first GPM control data GPMD1.

Equation 2 is used to reduce the magnitude of the first GPM control data GPMD1, and if the number of bits allocated to the first GPM control data GPMD1 is sufficiently large, the size of the first GPM control data GPMD1 may be set to the GPM count value CG.

The GPM control signal GPMC turns on the discharge control transistor Mdis illustrated in FIG. 12. FIG. 13 illustrates a GPM control signal in which a high level voltage has an ON level and a low level voltage has an OFF level. The ON-level GPM control signal GPMC may be a turn-on voltage of the discharge control transistor Mdis. Alternatively, the ON-level GPM control signal GPMC may be a logic voltage and may be amplified to a turn-on voltage of the discharge control transistor Mdis through a buffer (not shown).

When the discharge control transistor Mdis is turned on in response to the ON-level GPM control signal GPMC, a current path is formed between the output terminal Nout for outputting the scan clock SCCLK and the ground voltage GND. As a result, the voltage level of the scan clock SCCLK gradually decreases from the gate high level VGH.

The comparator 421 generates a falling signal VD when the GPM voltage VG is equal to or higher than the voltage of the discharge node Ndis, and applies the falling signal VD to the GPM control signal generator 415. The GPM control signal generator 415 inverts the GPM control signal GPMC to an OFF level from a time point when the falling signal VD is received. As the GPM control signal GPMC is inverted to the OFF level, the discharge control transistor Mdis is turned off and the operation of discharging the scan clock SCCLK is stopped.

The gate clock generator of the third embodiment may adjust a modulation timing of the scan clock SCCLK in units of lines on the basis of the first GPM control data GPMD1. In addition, the gate clock generator 400 of the third embodiment may adjust the GPM voltage level of the scan clock SCCLK in units of lines on the basis of the second GPM control data GPMD2.

As described above, the gate clock generator according to the present disclosure may separately control the pulse width, the slew rate, and the GPM voltage level of the gate signals applied to each of the gate lines. Therefore, the present disclosure may be applied to various display devices, without being limited to a specific model. In addition, each of the gate clocks may be separately modulated in order to solve the problems inherent in a particular specification of a display device and problems that may arise when the display device is driven.

Hereinafter, a specific embodiment of an organic light emitting display device to which the gate clock generator of the present disclosure is applied will be described.

Figure 15:
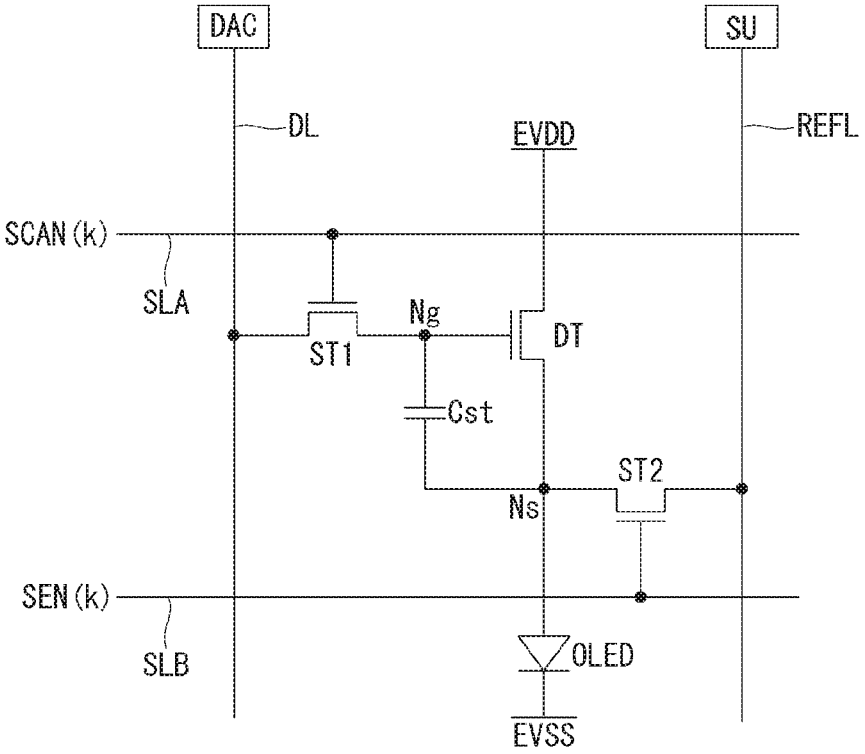
FIG. 15 is a view illustrating an example of a pixel.

FIG. 15 is a view illustrating an embodiment of a pixel arranged in a k-th (k is a natural number of n or smaller) pixel line in FIG. 1.

Referring to FIG. 15, a pixel P may include a driving transistor DT, a storage capacitor Cst, a first transistor ST1, and a second transistor ST2. The driving transistor DT controls a driving current flowing at the organic light emitting diode OLED according to a gate-source voltage Vgs. The driving transistor DT includes a gate electrode connected to a first node Ng, a drain electrode connected to an input terminal of a high potential driving voltage EVDD, and a source electrode connected to a second node Ns. The storage capacitor Cst is connected between the first node Ng and the second node Ns. The first transistor ST1 includes a gate electrode connected to an input terminal of the scan signal SCAN(k), a drain electrode connected to the data line DL, and a source electrode connected to the first node Ng. The second transistor ST2 includes a gate electrode connected to an input terminal of a sense signal SEN(k), a drain electrode connected to the second node Ns, and a source electrode connected to a reference voltage line REFL.

The data line DL is supplied with a data voltage through a digital-to-analog converter (DAC) of the data driver 300 and the reference voltage line REFL is connected to a sensing unit SU. The sensing unit SU supplies a reference voltage through the reference voltage line REFL of the pixel or acquires a sensing voltage of the first node Ng.

The organic light emitting display device according to an embodiment of the present disclosure may adopt a technique of inserting a black image to shorten a moving picture response time (MPRT). The black data insertion (BDI) technique is to display a black image between neighboring image frames to effectively erase an image of a previous frame. The outline of the BDI technique and the operation of the gate clock generator of the present disclosure which may be applied thereto will be described below.

Figure 16:
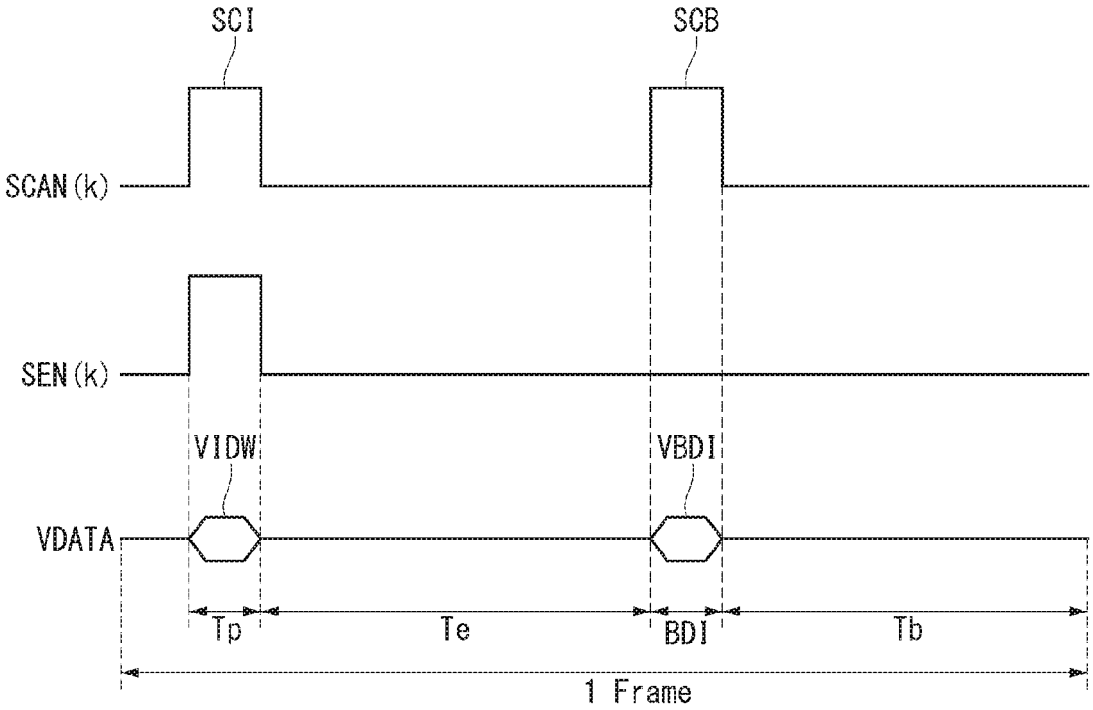
FIGS. 16 to 18 are views illustrating driving signals for black image insertion driving.
Figure 17:
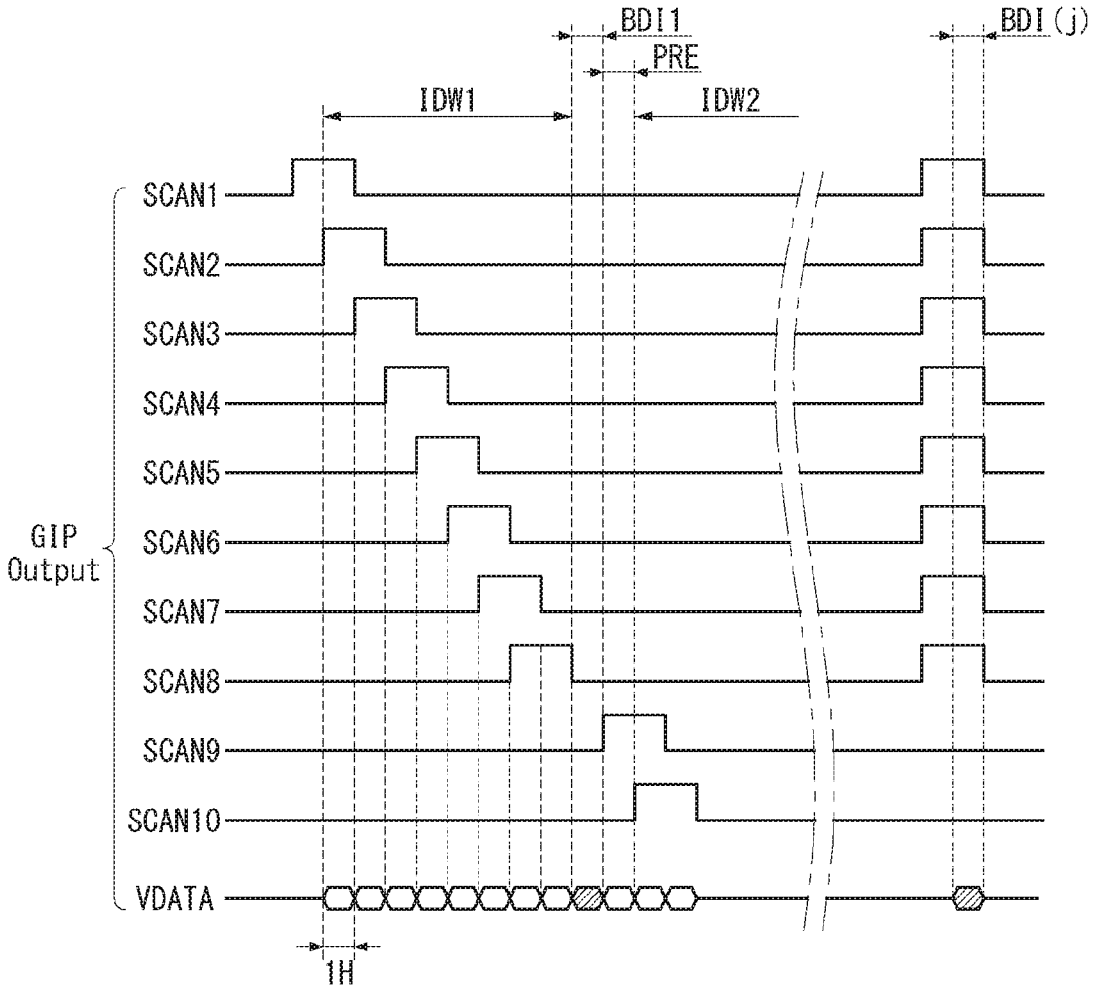
Figure 18:
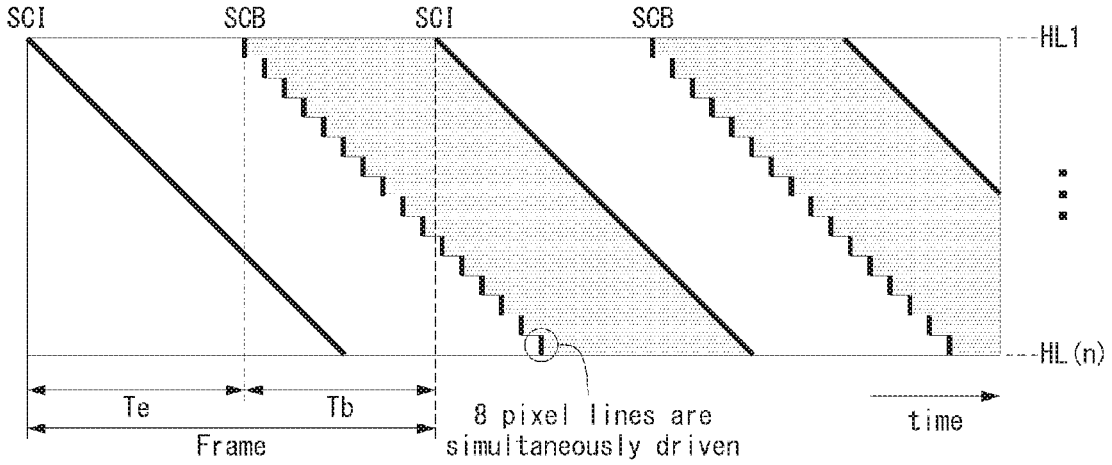
Figure 19:
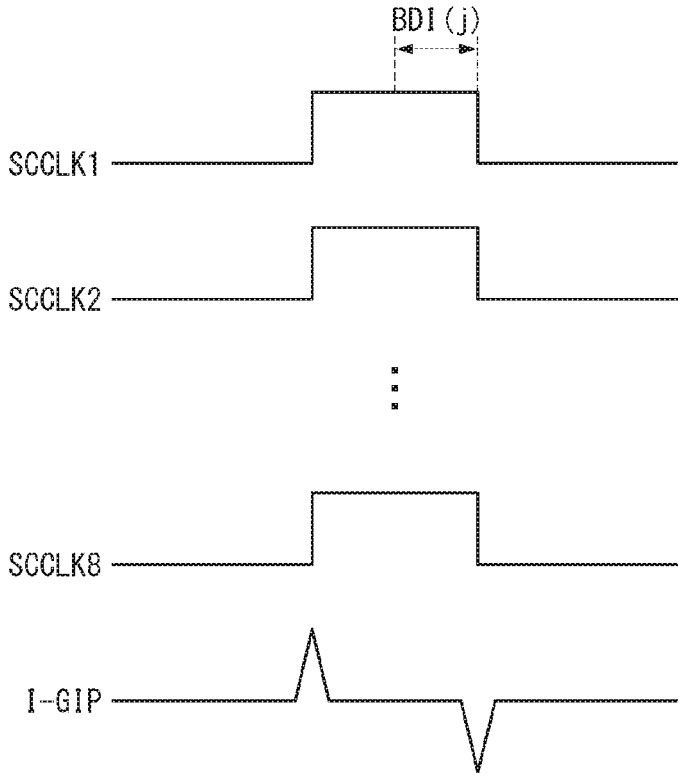
FIG. 19 is a view illustrating a panel current.

FIG. 16 is a view illustrating a scan signal and a sense signal applied to a k-th pixel line. FIG. 17 is a timing chart of first to tenth scan signals for BDI driving. FIG. 18 is a view illustrating, in units of frames, a timing at which scan signals for BDI driving are applied.

Referring to FIGS. 16 to 18, each of the scan signals has an output period set to 1H or more to perform overlap driving. Each of the scan signals includes a scan signal SCI for data writing and a scan signal SCB for BDI.

During the first image data write interval IDW1 of a 8H period, the scan signals SCI for data writing of first to eighth scan signals SCAN1 to SCAN8 are sequentially applied to the first to eighth scan lines SCL. During a first image data write interval IDW11, a data voltage VDATA synchronized with the data write scan signals SCI is supplied to the data line DL.

During a first BDI interval BDI1 of the 1H period, the scan signals SCB for BDI are substantially simultaneously applied to eight contiguous pixel lines. The scan signals for BDI applied to first to eighth pixel lines HL1 to HL8 may be applied during the BDI interval BDI(j) (j is a certain natural number equal to or smaller than "n/8"). During the BDI interval, a data voltage for displaying a black image is applied to the data line DL.

A first precharge interval PRE1 of the 1H period is an interval for precharging a ninth pixel line HL9 using a ninth scan signal SCANS.

As described above, during the BDI interval, a plurality of scan signals are substantially simultaneously applied to the display panel DIS. In order to output a plurality of scan signals, the gate clock generator 400 substantially simultaneously outputs a plurality of scan clocks SCCLK. For example, as illustrated in FIG. 17, the first to eighth scan clocks SCCLK1 to SCCLK8 are substantially simultaneously applied to the shift register 500 during the BDI interval BDI(j).

At a rising time and a falling time of the scan clocks SCCLK, a large voltage change occurs in the shift register 500 and a panel current I-GIP is generated in the display panel DIS. In particular, a larger panel current I-GIP is generated when the plurality of scan clocks SCCLK are substantially simultaneously applied to the shift register 500 during the BDI interval. The instantaneously generated panel current I-GIP induces electromagnetic interference (EMI). Since EMI is proportional to a current variation, larger EMI is generated at a start point and an end point of the BDI interval.

To improve this, the gate clock generator of the present disclosure controls the slew rate of the scan clocks output during the BDI interval.

Figure 20:
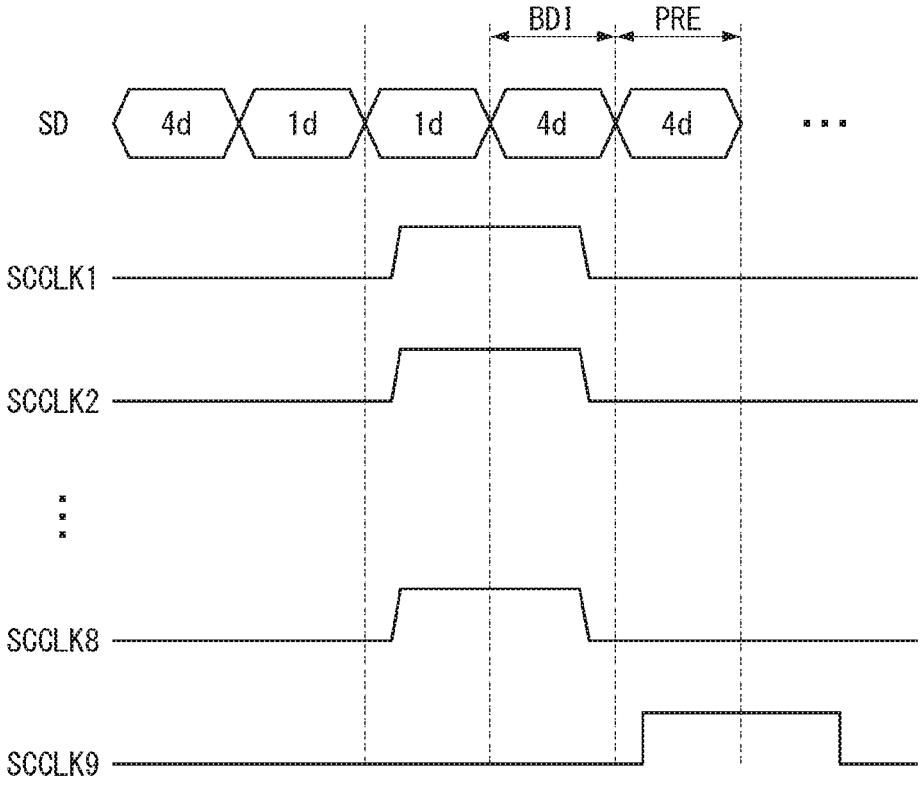
FIG. 20 is a view illustrating an embodiment for controlling a slew rate of a scan clock in the organic light emitting display device according to the present disclosure.

FIG. 20 is a view illustrating an example of slew rate data for controlling a slew rate during the BDI interval. FIG. 20 illustrates an application of the second embodiment described based on FIGS. 5 to 10.

Referring to FIG. 20, the slew rate data SD for controlling the slew rate of the image data write interval is set to "4*d*" to control the slew rate by 100%. The slew rate data SD for controlling the BDI interval is set to "1*d*" to control the slew rate by 70%. In this manner, a voltage variation of the scan clocks SCCLK applied to the display panel DIS may be lowered by lowering the slew rate during the BDI interval. As a result, the panel current I-GIP may be reduced and EMI is also reduced.

In the process of applying the BDI, brightness deviation may occur between the pixel lines, and in order to improve this, an operation of the gate clock generator is as follows.

First, an operation of the pixel will be described as follows.

Figure 21:
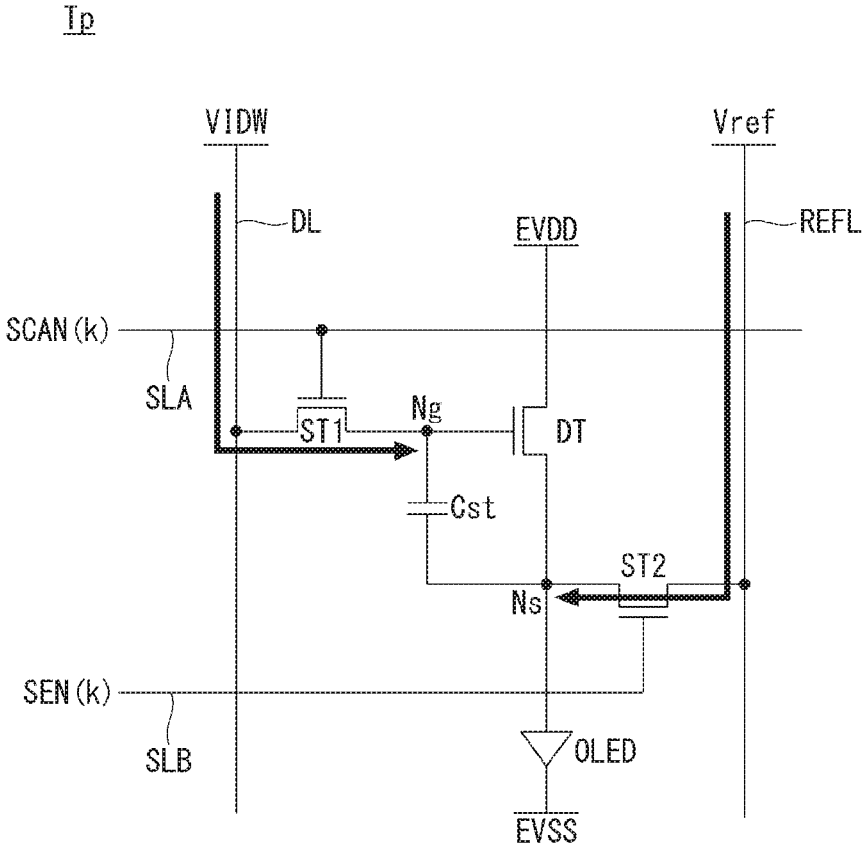
FIG. 21 is an equivalent circuit diagram of a pixel in a programming interval.
Figure 22:
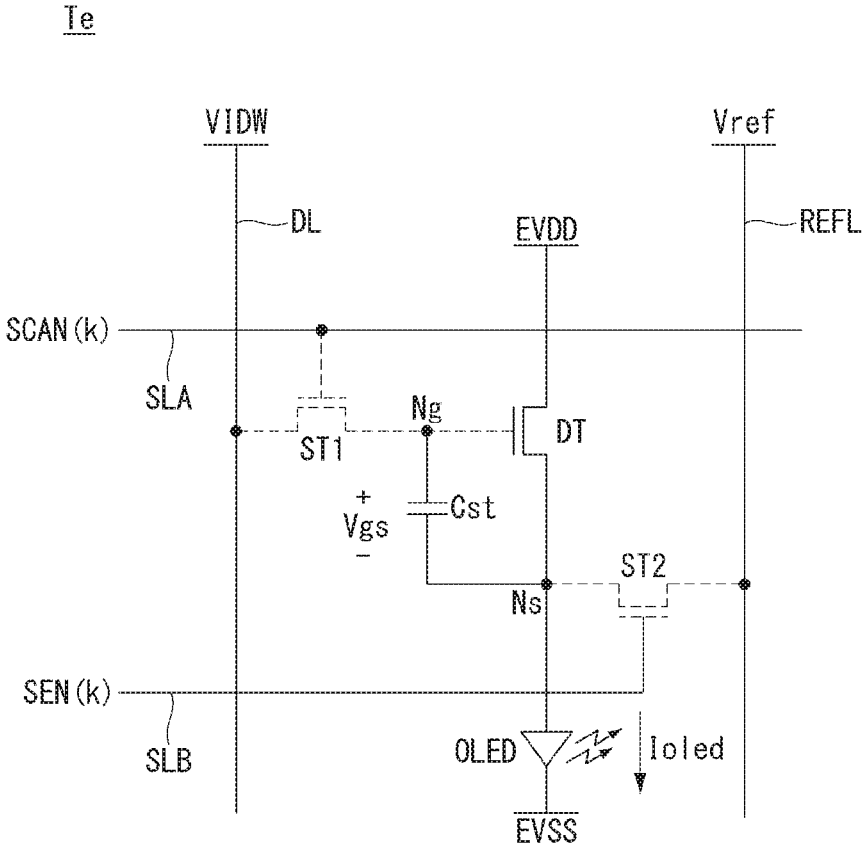
FIG. 22 is an equivalent circuit diagram of a pixel in a light emission interval.
Figure 23:
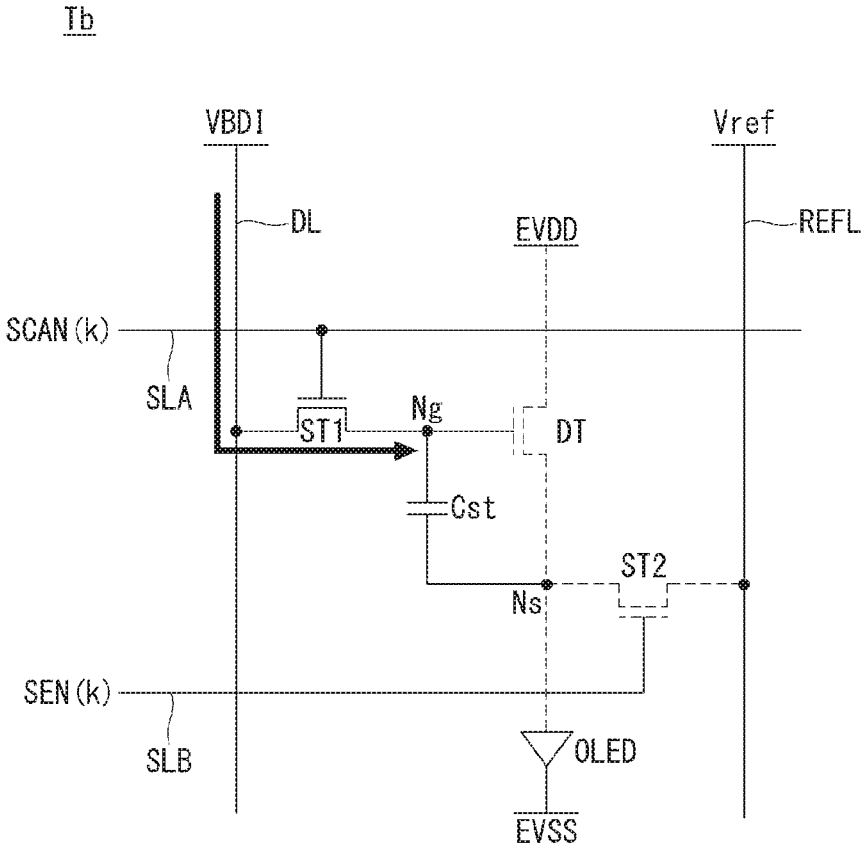
FIG. 23 is an equivalent circuit diagram of a pixel in a black data insertion interval.

FIG. 21 is an equivalent circuit diagram of a pixel corresponding to a programming interval, and FIG. 22 is an equivalent circuit diagram of a pixel corresponding to a light emission interval. FIG. 23 is an equivalent circuit diagram of a pixel corresponding to a black data insertion interval.

Referring to FIG. 21, during the programming interval Tp, the first transistor ST1 of the pixel is turned on according to the scan signal SCI for image data writing to apply a data voltage VIDW for image data writing to the first node Ng. During the programming interval Tp, the second transistor ST2 of the pixel is turned on according to the sense signal SEN to apply a reference voltage Vref to the second node Ns. Accordingly, during the programming interval Tp, a voltage between the first node Ng and the second node Ns of the pixel is set to fit a desired pixel current.

Referring to FIG. 22, during the light emission interval Te, the first transistor ST1 and the second transistor ST2 of the pixel are turned off. In FIGS. 22 and 23, a dashed line of a circuit element or a circuit path indicates it is disabled (e.g., turned off) at that particular time. The voltage Vgs between the first node Ng and the second node Ns set in the programming interval Tp is also maintained during the light emission interval Te. Since the voltage Vgs between the first node Ng and the second node Ns is larger than a threshold voltage of the driving transistor DT of the pixel, a pixel current Ioled flows through the driving transistor DT of the pixel during the light emission interval Te. A potential of the first node Ng and a potential of the second node Ns are boosted, while maintaining the voltage Vgs between the first node Ng and the second node Ns, by the pixel current Ioled during the light emission interval Te. When the potential of the second node Ns is boosted up to an operating point level of the organic light emitting diode OLED, the organic light emitting diode OLED emits light.

Referring to FIG. 23, during the BDI interval Tb, the first transistor ST1 of the pixel is turned on in response to the scan signal SCB for BDI to apply the data voltage VBDI for BDI to the first node Ng. During the BDI interval Tb, the second transistor ST2 of the pixel maintains the turn-off state, and thus, the potential of the second node Ns maintains the operating point level of the organic light emitting diode OLED. The data voltage VBDI for BDI is lower than the operating point level of the organic light emitting diode OLED. Therefore, since the voltage Vgs between the first node Ng and the second node Ns is smaller than the threshold voltage of the driving transistor DT during the BDI interval Tb, the pixel current Ioled does not flow at the driving transistor DT of the pixel and the organic light emitting diode OLED stops emitting light.

As described above, brightness of the organic light emitting diode OLED in the light emission interval Te is determined by the voltage difference Vgs between the first node Ng and the second node Ns of the driving transistor DT set in the programming interval Tp. Here, the reference voltage Vref applied to the second node Ns must be the same for all the pixel lines HL1 to HL(n). However, between the pixels connected to the same reference voltage line REFL, the voltage of the second node Ns may vary due to IR deviation of the reference voltage line REFL, thereby causing a brightness deviation between the pixel lines. This will be described with reference to FIGS. 24 and 25.

Figure 24:
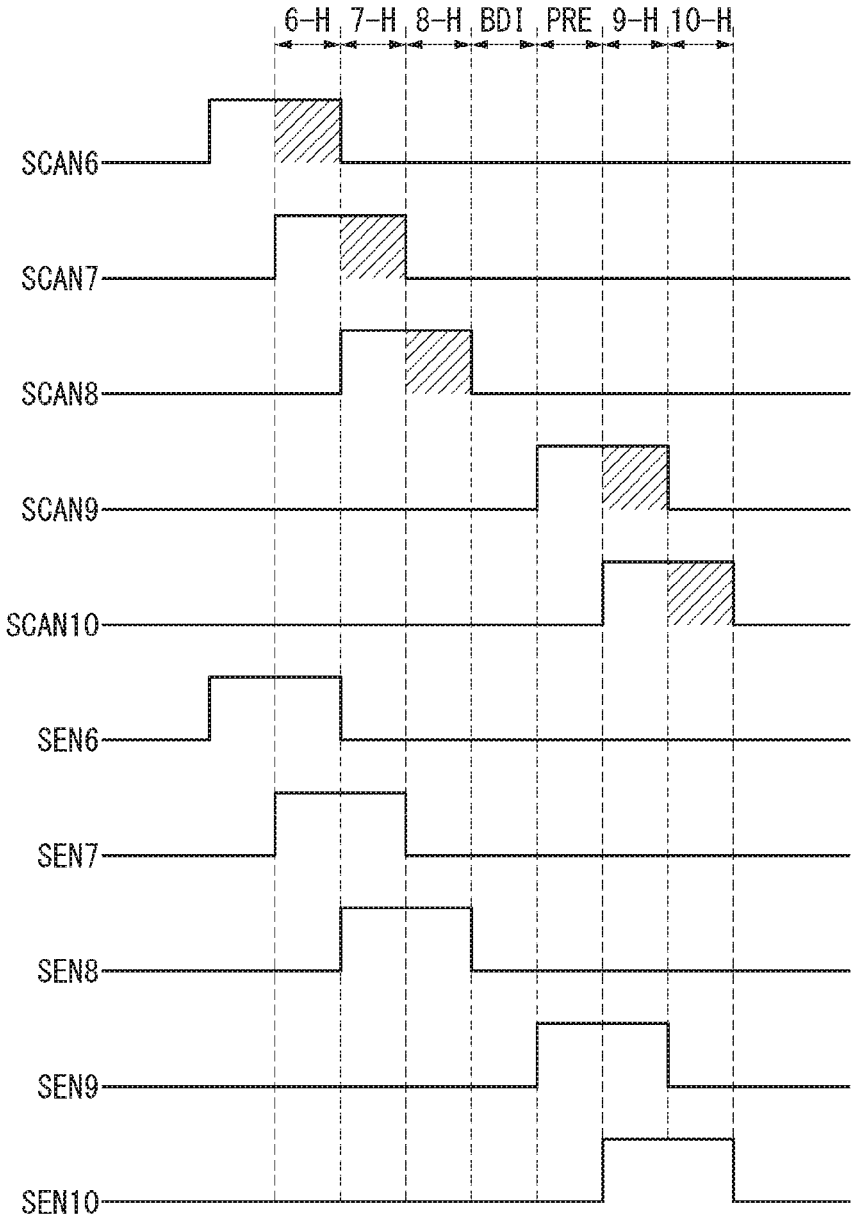
FIG. 24 is a timing diagram of scan signals and sense signals during sixth to tenth horizontal periods.
Figure 25:
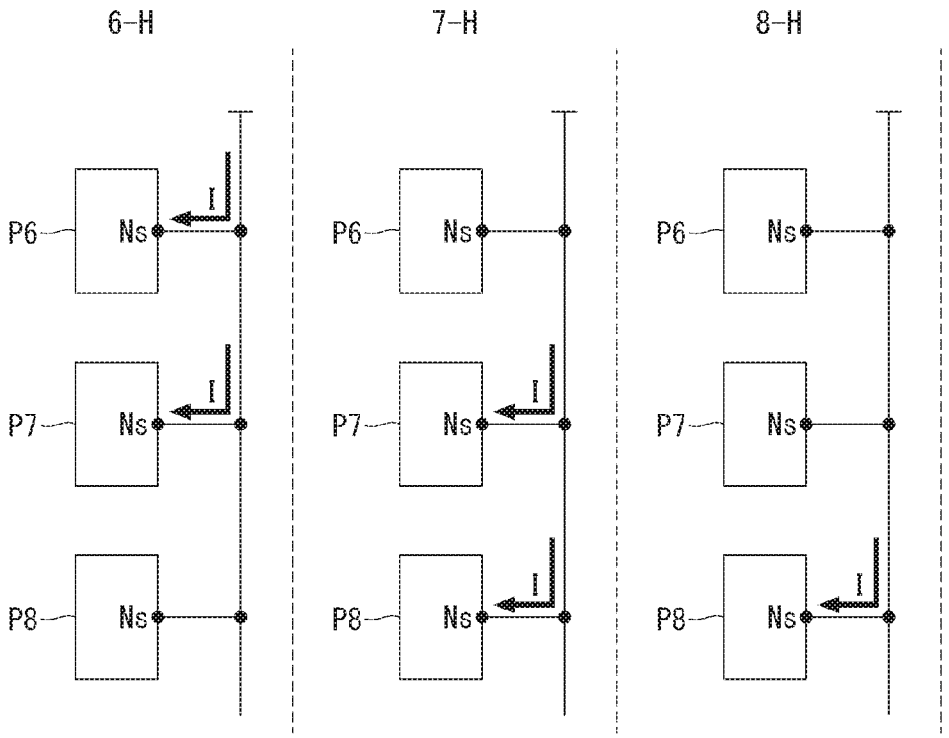
FIG. 25 is a view illustrating IR deviations between the sixth to eighth pixels.

FIG. 24 is a view illustrating first to tenth scan signals and sense signals applied during sixth to tenth horizontal periods. FIG. 25 is a view illustrating an IR deviation of pixels of the sixth to ninth pixel lines during the sixth to eighth horizontal periods. In FIGS. 24 and 25, the sixth horizontal period 6-H is a programming interval of the pixel P6 (hereinafter, referred to as a sixth pixel) arranged in the sixth pixel line. The seventh horizontal period 7-H is a programming interval of a pixel P7 (hereinafter, referred to as a seventh pixel) arranged in the seventh pixel line, and the eighth horizontal period 8-H is a programming interval of a pixel P8 (hereinafter, referred to as an eighth pixel).

Referring to FIGS. 24 and 25, during the sixth horizontal period 6-H, the sixth and seventh sense signals SEN6 and SEN7 are turn-on voltages, and thus, current flows between the second node Ns of the sixth and seventh pixels and the reference voltage line REFL. During the seventh horizontal period 7-H, the seventh and eighth sense signals SEN7 and SEN8 are turn-on voltages, and accordingly, current flows between the second node Ns of the seventh and eighth pixels P7 and P8 and the reference voltage line REFL. During the eighth horizontal period 8-H, the eighth sense signal SEN is a turn-on voltage, and accordingly, current flows between the second node Ns of the eighth pixel P8 and the reference voltage line REFL.

It is ideal that the second node Ns is set to the reference voltage Vref when the second node Ns of the pixels and the reference voltage line REFL are electrically connected. However, the voltage of the second node Ns varies depending on the IR deviation. For example, a voltage variation occurs in proportion to "2I×R" at the second node Ns of the sixth pixel P6 in the sixth horizontal period 6-H and at the second node Ns of the seventh pixel P7 in the seventh horizontal period 7-H. Meanwhile, a voltage variation occurs in proportion to "IR" at the second node Ns of the eighth pixel P8 in the eighth horizontal period 8-H. Thus, although the same data voltage is applied to the sixth to eighth pixels P6 to P8, the eighth pixel P8 programmed in the eighth horizontal period 8-H represents different brightness as compared with the sixth and seventh pixels P6 and P7.

Figure 26:
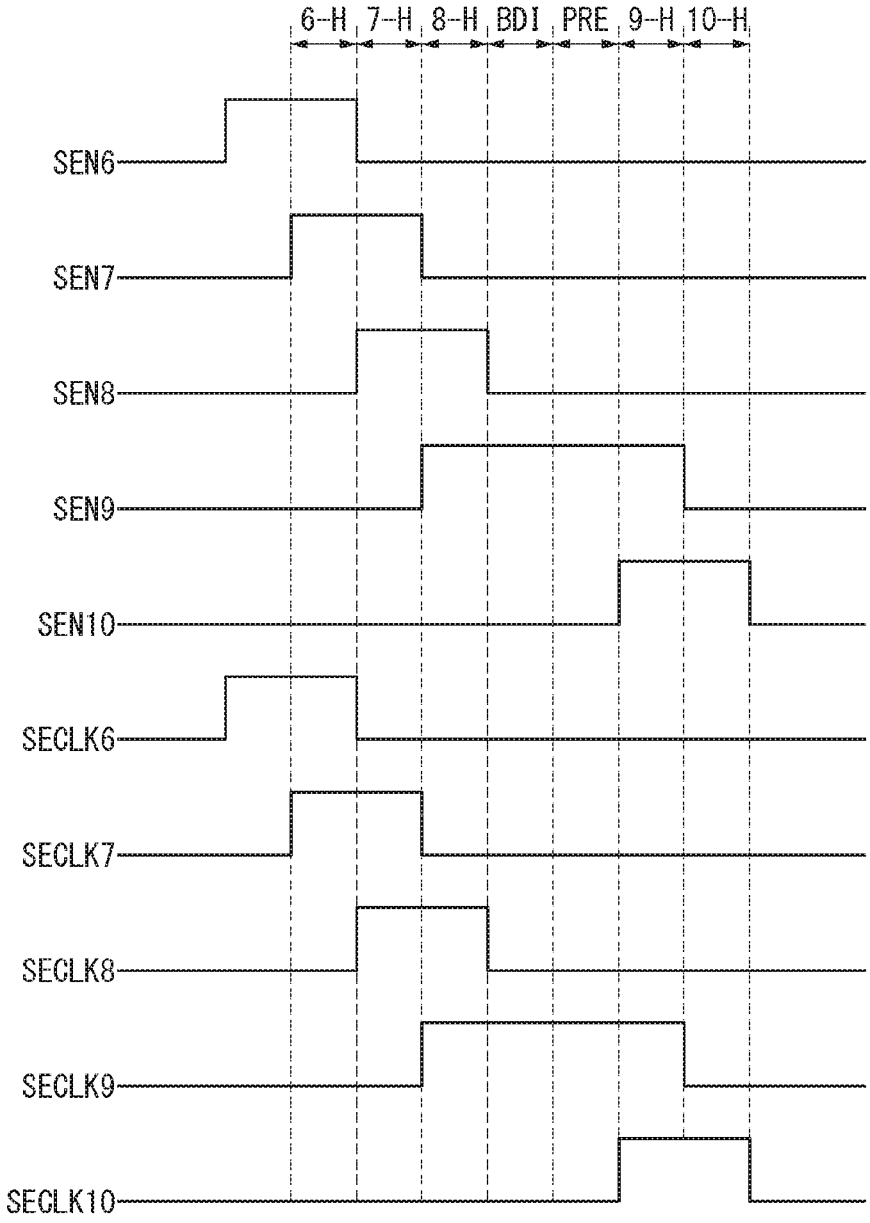
FIG. 26 is a view illustrating an embodiment for controlling pulse widths of sense clocks in an organic light emitting display device according to the present disclosure.

FIG. 26 is a view illustrating a sense clock output from the gate clock generator and a sense signal generated by the shift register on the basis of the sense clock according to the present disclosure.

Referring to FIG. 26, the gate clock generator 400 advances a rising time of a first sense clock SEN, e.g., the ninth sense clock SECLK9, after the BDI interval so that the ninth sense clock SECLK9 overlaps a falling time of the eighth sense clock SECLK8. As a result, the ninth sense signal SEN9 overlaps the eighth sense signal SEN8, and the second node Ns of the ninth pixel P9 has the same IR deviation as the second node Ns of the other pixels.

As a method of adjusting the rising time of the ninth sense clock SECLK9, the embodiment described above with reference to FIGS. 2 and 3 may be used.

Since the gate clock generator according to the present disclosure can separately control the gate clocks, it may be applied to various gate driving methods.

In the present disclosure, since the timing of the gate clock is adjusted on a line-by-line basis, a pulse width of a gate pulse applied to a specific line may be extended. In addition, output order of the gate pulse may be changed without changing the shift register.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A gate clock generator, comprising:

a counter receiving a main clock and a control data, the control data having rising timing information and falling timing information and, the counter configured to:

generate a first output when a value obtained by counting the main clock from a preset reference time point reaches a time point defined in the rising timing information, and generate a second output when the value obtained by counting the main clock from the reference time point reaches a time point defined in the falling timing information;

a buffer control signal generator generating a first buffer control signal of a gate ON voltage from a timing of the first output to a timing of the second output; and a buffer unit outputting a gate ON voltage of a gate clock through an output terminal during a gate ON voltage output period of the first buffer control signal.

2. The gate clock generator of claim 1, wherein the buffer control signal generator further generates a second buffer control signal whose gate ON voltage period is the opposite to a gate ON voltage period of the first buffer control signal; and the buffer unit includes:

a pull-up unit connecting an input terminal of a gate high voltage to an output terminal of the gate clock in response to the first buffer control signal; and a pull-down unit connecting a gate low voltage to the output terminal of the gate clock in response to the second buffer control signal.

3. The gate clock generator of claim 2, wherein the pull-up unit includes a plurality of PMOSs each having a source electrode connected to the input terminal of the gate high voltage and a drain electrode connected to the output terminal of the gate clock; and the pull-down unit includes a plurality of NMOSs each having a source electrode connected to an input terminal of the gate low voltage and a drain electrode connected to the output terminal of the gate clock.

4. The gate clock generator of claim 3, wherein the control data includes first slew rate data; and the gate clock generator further comprising:

a first multiplexer including a plurality of pull-up control switches connecting an input terminal of the first buffer control signal to each of respective gate electrodes of the PMOSs; and a multiplexer controller adjusting a number of the pull-up control switches to be turned on in proportion to the first slew rate data.

5. The gate clock generator of claim 3, wherein the control data further includes second slew rate data; and the gate clock generator, further comprising:

a second multiplexer including a plurality of pull-down control switches connecting an input terminal of the second buffer control signal to each of respective gate electrodes of the NMOSs; and a multiplexer controller adjusting the number of pull-down control switches to be turned on in proportion to the second slew rate data.

6. The gate clock generator of claim 1, wherein the reference time point is set to a time point after the lapse of a predetermined period after the digital data is input.

7. The gate clock generator of claim 1, further comprising:

a gate pulse modulation (GPM) controller including a discharge control transistor connected between the output terminal and an input terminal of a ground voltage; and a GPM control signal generator generating a GPM control signal for controlling the discharge control transistor, wherein the control data further includes first GPM control data including GPM timing information for determining an output timing of the GPM control signal.

8. The gate clock generator of claim 7, wherein the counter generates a third output when the value obtained by counting the main clock from the reference time point reaches the GPM timing information; and the GPM control signal generator outputs the GPM control signal as a turn-on voltage from a timing of the third output.

9. The gate clock generator of claim 7, wherein the GPM controller includes:

a GPM level adjusting unit generating a GPM voltage having a voltage level equal to or lower than a gate high voltage; and a comparator comparing a voltage of a discharge node positioned between the discharge control transistor and the input terminal of the ground voltage with the GPM voltage and generating a falling signal when the GPM voltage is equal to or higher than the voltage of the discharge node, wherein the GPM control signal generator inverts a voltage level of the GPM control signal to an OFF level at a timing of the falling signal.

10. The gate clock generator of claim 9, wherein the control data further includes second GPM control data including GPM level information; and the GPM level adjusting unit adjusts a voltage level of the GPM voltage according to the second GPM control data.

11. An organic light emitting display device, comprising:

a display panel including pixels, each pixels including an organic light emitting diode, a driving transistor, and data lines and gate lines connected to the pixels;

a reference data generator generating reference data for setting an output timing of a gate pulse applied to the gate lines;

a gate clock generator generating a gate clock based on the reference data; and a shift register generating a gate signal having a gate ON level during a gate ON level interval of the gate clock, wherein the gate clock generator includes:

a counter configured to, receive digital control data having rising data and falling data and a main clock, generate a first output when a value obtained by counting the main clock from a preset reference time point reaches the rising data, and generate a second output when the value obtained by counting the main clock from the reference time point reaches the falling data;

a buffer control signal generator generating a first buffer control signal of a gate ON voltage from a timing of the first output to a timing of the second output; and an output unit outputting a gate ON voltage of the gate clock during a gate ON voltage output period of the first buffer control signal.

12. The organic light emitting display device of claim 11, wherein the gate signal includes a scan signal for controlling a first transistor connected to the data line and the pixel; and the gate driver sequentially outputs the scan signal during an image data write period and substantially simultaneously outputs a plurality of scan signals during a black image insertion period.

13. The organic light emitting display device of claim 12, wherein the gate clock generator outputs a scan clock for determining an output timing of the scan signal, and adjusts a slew rate of the scan signal output during the black image insertion period to be lower than a slew rate of the scan signal output during the image data write period.

14. The organic light emitting display device of claim 13, wherein the buffer control signal generator further generates a second buffer control signal whose voltage level is opposite to a voltage level of the first buffer control signal; and the output unit includes:

a pull-up unit including a plurality of PMOSs each having a source electrode connected to an input terminal of the gate high voltage and a drain electrode connected to an output terminal of the gate clock;

a pull-down unit including a plurality of NMOSs each having a source electrode connected to an input terminal of the gate low voltage and a drain electrode connected to an output terminal of the gate clock; and the gate clock generator adjusts a rate of change at which the output terminal rises to the gate high voltage by adjusting the number of the PMOSs to be turned on.

15. The organic light emitting display device of claim 14, wherein the gate clock generator adjusts a rate of change at which the output terminal falls to the gate low voltage by adjusting the number of the NMOSs to be turned on.

16. The organic light emitting display device of claim 12, wherein the gate signal includes a sense signal for controlling a reference voltage line supplying a reference voltage and a second transistor connected to a source node of the driving transistor; and the gate clock generator outputs a sense clock for determining an output timing of the sense signal such that a gate ON voltage level interval of the sense clock first output after the black image insertion period at least partially overlaps a gate ON voltage level interval of the sense clock finally output before the black image insertion period.

* * * * *